United States Patent [19]

Lloyd

[11] Patent Number: 4,907,661

[45] Date of Patent: Mar. 13, 1990

[54] DRILL PIPE TUBING AND CASING PROTECTORS

[75] Inventor: Stephen F. Lloyd, Aberdeen, United Kingdom

[73] Assignee: Giselle Mary Herrera, Westhill Aberdeen, United Kingdom; a part interest

[21] Appl. No.: 197,227

[22] Filed: May 23, 1988

[30] Foreign Application Priority Data

May 21, 1987 [GB] United Kingdom ..... 8712024

[51] Int. Cl.[4] ..... E21B 17/10

[52] U.S. Cl. ..... 175/325; 166/241

[58] Field of Search ..... 175/325, 320; 166/241, 166/173, 175; 138/103, 108, 110

[56] References Cited

U.S. PATENT DOCUMENTS

| | | | |
|---|---|---|---|
| 2,368,415 | 1/1945 | Grant | 175/325 |
| 2,715,552 | 8/1955 | Lane | 175/325 |
| 2,793,917 | 5/1957 | Ward | 175/325 |
| 2,943,009 | 6/1960 | Mirsky et al. | 175/325 X |
| 3,282,345 | 11/1966 | Tripplehorn | 175/325 X |
| 3,343,890 | 9/1967 | Homer | 175/325 |
| 3,370,894 | 2/1968 | Pourchot | 175/325 |
| 3,397,017 | 8/1968 | Grant et al. | 175/325 |
| 3,948,575 | 4/1976 | Rosser | 175/325 |
| 4,372,622 | 2/1983 | Cheek | 175/325 |

*Primary Examiner*—Stephen J. Novosad

*Attorney, Agent, or Firm*—Arnold S. Weintraub

[57] ABSTRACT

Each section (1) of a drill pipe string carries a substantially annular protector (2) that is movable in a freely rotatable manner around (4) the longitudinal axis of the section (1) concerned. Each protector (2) is also movable lengthwise (3) throughout the length of the section (1) between junctions at its opposite ends or to an extent that is limited by retaining rings secured in appropriate positions around the section (1). Each protector (2) is formed from a relatively hard material having a very low co-efficient of friction, such as polytetrafluoroethylene, and is advantageously produced in two separable halves (FIG. 3) to facilitate embracing assembly around, or quick removal from, the co-operating pipe section (1). If necessary, the protectors (2) may be formed throughout their axial thicknesses with flutes significantly to reduce the fluid flow constraint produced by the presence of the protectors (2).

7 Claims, 7 Drawing Sheets

DRILL PIPE TUBING AND CASING PROTECTORS

This invention relates to drill pipe tubing and casing protectors.

During the drilling of an oil or gas well, a so-called drill string pipe is conventionally employed carrying a drill bit or other cutting tool at its lower operative end. Such pipe strings can eventually have a very considerable length which can sometimes exceed 9000 meters. It is uncommon, for a number of reasons, for a pipe string to be of strictly rectilinear configuration and it is, in fact, common practice deliberately to drill a bore hole of gently curved configuration so that a number of such bore holes can be produced from a single drilling platform with their lowermost ends spread over a considerable area around that single platform. Whether straight or gently curved, it is conventional practice to line the wall of a bore hole with steel piping as the length of that bore hole progressively increases. This steel piping is generally known as a bore hole casing and it will be realised that the pipe string which partially fills this casing, and which initially carries the drill bit or other cutting tool and subsequently carries therethrough the oil or gas from the well concerned, frequently contacts the surrounding bore hole casing inevitably causing frictional wear of the metallic drill string itself and similar wear or other damage to the surrounding casing.

The bore hole casing has several functions. A primary function is to isolate successive geological levels and corresponding soil and rock formations from one another so far as the interior of the bore hole is concerned. Thus, the casing prevents fluids in its interior from reaching its exterior and vice versa except, of course, at the level or levels from which oil or gas is to be obtained. The oil or gas is usually, although not always, under very high natural pressure and the ability of the bore hole casing to resist this pressure depends upon the thickness and integrity of the casing and the strength of the steel from which it is formed. It will immediately be realised that any portion of the casing which is subject to this high pressure and that is worn thin by frictional contact with the rotating drill string pipe will eventually rupture if the frictional wear continues, a consequent shut-down of the drilling operation then being necessary with lengthy and expensive remedial work being required before the casing is restored to a fully effective condition. Frequently, the length of productive life of a well is determined substantially wholly by the duration of the integrity of its bore hole casing. It has been the practice, for a considerable period of time, to try and eliminate, or at least reduce, the frictional wear that has been discussed above by providing protectors along the length of the drill pipe string. These protectors are usually formed from an elastomeric material in an annular shape and are placed around the drill pipe string at appropritate intervals therealong. However, the known protectors have all been designed firmly to grip the periphery of the drill pipe and, to enable the protectors to achieve this grip, the elastomeric material thereof contains resilient metallic reinforcements which can themselves present a danger inasmuch as they can damage the drill pipe or casing should the grip fail and the protectors become moved relative to the drill pipe.

The present invention seeks to provide protectors which achieve their protective function in a basically different way to the known reinforced elastomeric protectors which occupy fixed positions relative to the drill pipe sections which they surround and, for a better understanding of the invention, and to show how the same may be carried into effect, reference will now be made, by way of example, to the accompanying drawings, in which.

FIGS. 8 to 13 inclusive are somewhat diagrammatic side elevations showing various constructions and arrangements of protectors in accordance with the invention on drill pipe sections in bore hole casings, the choice being dependent upon the geological and other features of the individual well concerned.

Figure 1:
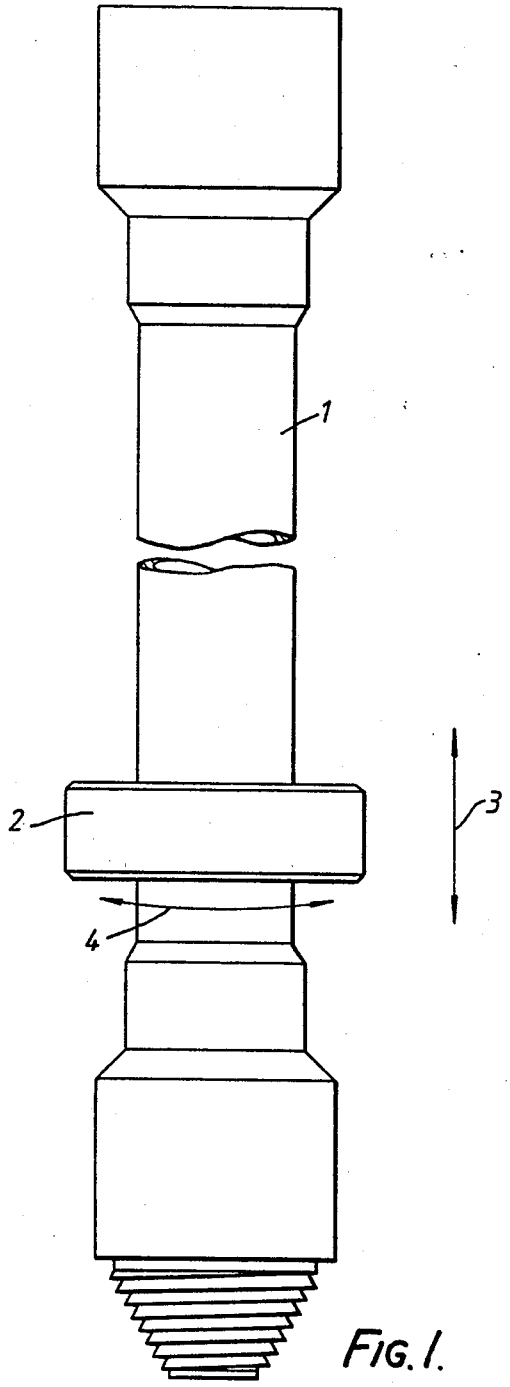
FIG. 1 is a side elevation of a single drill pipe section provided with a protector in accordance with the invention.

Referring to the accompanying drawings, FIG. 1 thereof shows a single drill pipe section 1 on which is mounted a single protector 2 in accordance with the invention, the construction and arrangement of the latter being such that it can move both axially upwards and downwards along the drill pipe section 1 in directions 3 that are substantially parallel to the longitudinal axis of the section 1 and/or can move rotationally around the longitudinal axis of the section 1 in either of two opposite directions 4. Movement of the illustrated protector 2 in an upward direction 3 would tend to take place when the drill pipe section 1 concerned is moving downwardly and would result from the frictional contact between the protector 2 and the internal wall of the surrounding bore hole casing exerting a greater "retaining" force than the downward travel of the section 1 itself combined with the effective weight of the protector 2 in whatever fluid or semi-fluid medium surrounds the protector 2 at the time in question. In practice, the protector 2 will afford its protective function throughout substantially the whole length of the drill pipe section 1 concerned and, in particular, will generally become temporarily lodged at, or near to, that region of the surrounding bore hole casing that protrudes furthest towards the drill pipe string for any reason.

In order to prevent any significant frictional wear to either the drill pipe section 1 or the surrounding tubular bore hole casing, both the outer convex cylindrical surface of the generally annular protector 2 and the internal concave cylindrical surface thereof should, in accordance with a feature of the invention, be formed from a relatively hard material having a very low coefficient of friction. A primary example of such a material is polytetrafluoroethylene which may be in either an unfilled condition or be provided with a filler such as glass fibre, particulate graphite, small bronze spheres or molybdenum disulphide. An alternative to polytetrafluoroethylene, with or without at least one filler, is the nylon twelve polymer known commercially as "Lauramid" and still further materials may be suitable for the purpose, the primary requirements for such materials being that they should be of relatively high compressive strength and impact resistance whilst having a low coefficient of friction and being capable of provision with a smooth surface. Additionally, such materials should be at least as hard as, and preferably harder than, the materials that are conventionally employed for the production of protectors, all of these physical properties being retained without significant variation when the protectors are subject to elevated temperatures and pressures of the magnitude met with in the formation of oil and gas wells. Polytetrafluoroethylene or other protectors 2 having the design and material constraints which have just been briefly discussed could be added in the required numbers to drill pipe sections 1 without significantly increasing the resistance to rotation, and thus the drilling torque required, operatively to drive the drill pipe string. As will become apparent below, the protectors 2 may, under some circumstances, be free to "float" axially throughout the length of each section 1 or, under other circumstances, may be restricted as to the axial movement which is possible in the opposite directions 3 (FIG. 1).

Figure 2:
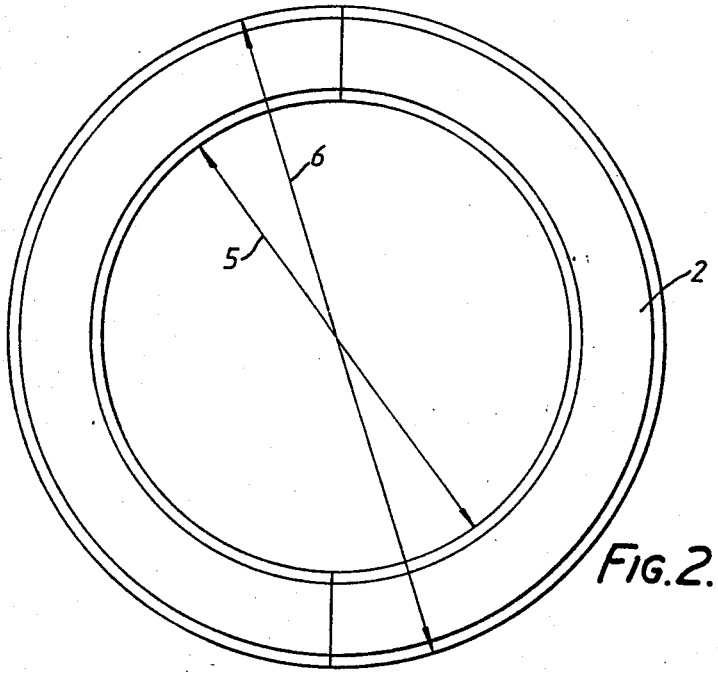
FIG. 2 is a plan view, to an enlarged scale, of a protector in accordance with the invention.
Figure 3:
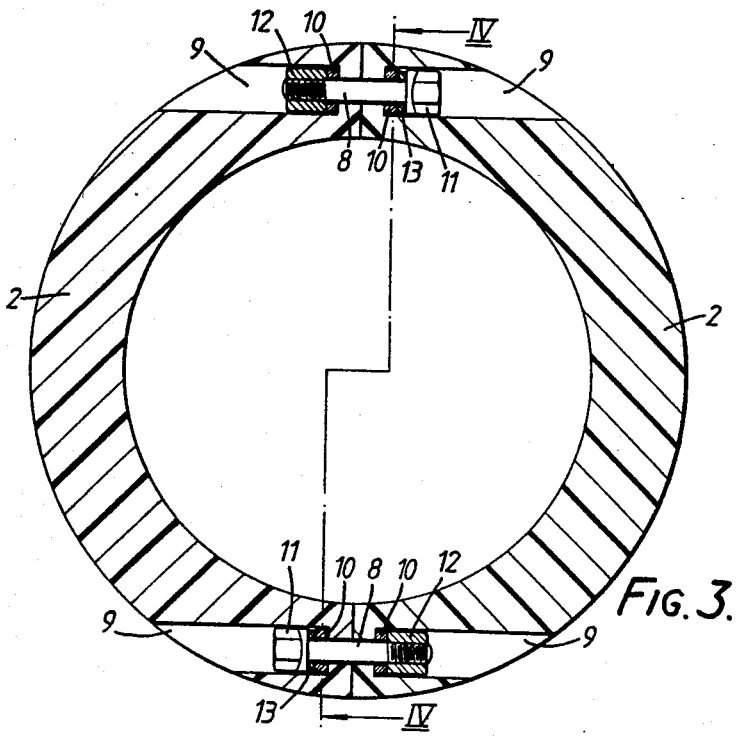
FIG. 3 is a transverse section of the protector of FIG. 2 taken on the line III—III in FIG. 4.
Figure 4:
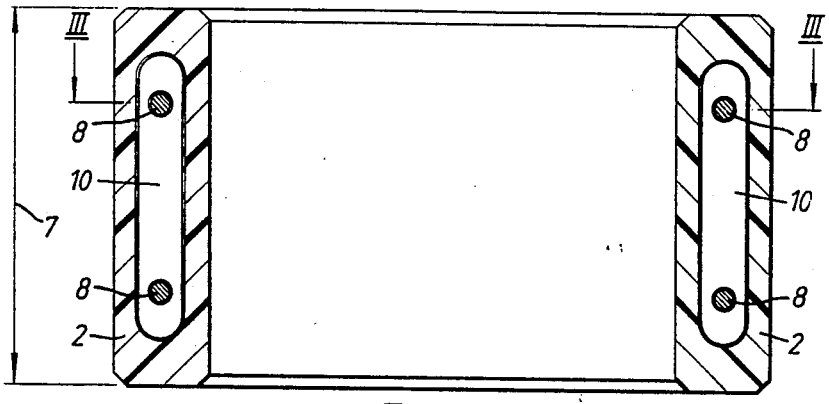
FIG. 4 is a vertical section taken on the line IV—IV in FIG. 3.

FIGS. 2, 3 and 4 of the drawings illustrate further details of the protector 2 that can be seen in FIG. 1. The generally annular protector 2 has an internal diameter 5 of substantially 128.6 mm and an external diameter 6 of substantially 179.4 mm. The protector 2 has an axial length/height 7 of substantially 101.6 mm. These dimensions are for the protector 2 when employed around a drill pipe section 1 having an external diameter of substantially 127 mm throughout a central region of its length around which, as shown in FIG. 1, the protector 2 will actually be located. The same section 1 has a maximum external diameter which does not exceed 177.8 mm and this maximum diameter is to be found at the opposite ends of the section where it is shaped to enable it to be connected to the preceeding and following pipe sections 1 of the string. Clearly the dimensions of the protector 1 that have just been given can be varied for co-operation with drill pipe sections 1 of other measurements. The external diameter 6 of the protector 2 will need to exceed the maximum external diameter of the drill pipe section 1 with which it is to be used but other factors may affect the dimensions of the protector 2 such as the internal diameter of the bore hole casing in which the drill pipe sections 1 and protectors 2 must easily fit and through the clearance between which fluid must be able to pass without significant restriction of its flow, this clearance conventionally being called "the annulus".

FIG. 3 is a section taken on the line or plane III—III in FIG. 4, this line or plane III—III being located substantially 25.4 mm from the upper end of the protector 2. The line or plane in question intersects the longitudinal axes of two upper bolts 8 whose arrangement can be seen best in FIG. 3. There are also two lower bolts 8 and each pair of upper and lower bolts 8 is located in a corresponding slot 9 formed in the polytetrafluoroethylene or other material of the "half" protector 2 concerned. Stainless steel plates 10 are lodged in the matchingly shaped slots 9 and each elongate plate 10 has rounded ends and measures substantially 76.2 mm in length and substantially 12.7 mm in width. Each plate 10 is formed with two holes which holes receive the shanks of the corresponding bolts 8 and register, of course, with aligned holes through the polytetrafluoroethylene or other material of the two "halves" of the protector 2 concerned. These aligned holes have diameters which substantially match those of the bolts 8 and are naturally significantly smaller than the widths of the slots 9. The bolts 8 preferably have recessed hexagon heads 11 and are provided, at their screw-threaded ends, with co-operating nuts 12. In addition, a lock washer 13 is arranged beneath the head 11 of each bolt 8 and between that head and the corresponding plate 10, the nuts 12 and the lock washers 13 being formed from stainless steel. It will be apparent from FIG. 3 of the drawings that the bolts 8 are so positioned that their heads 11 and nuts 12 will not become exposed even when the external surface of the protector 2 has inevitably become worn away to some extent. The stainless steel plates 10 spread the compressive load applied by the bolts 8 to secure the two halves of the protector 2 to one another and prevent the polytetrafluoroethylene or other material from being damaged. Obviously, should the axial height 7 of the protector be significantly greater, the bolts 8 could be appropriately re-positioned and/or could be increased in number.

Figure 5:
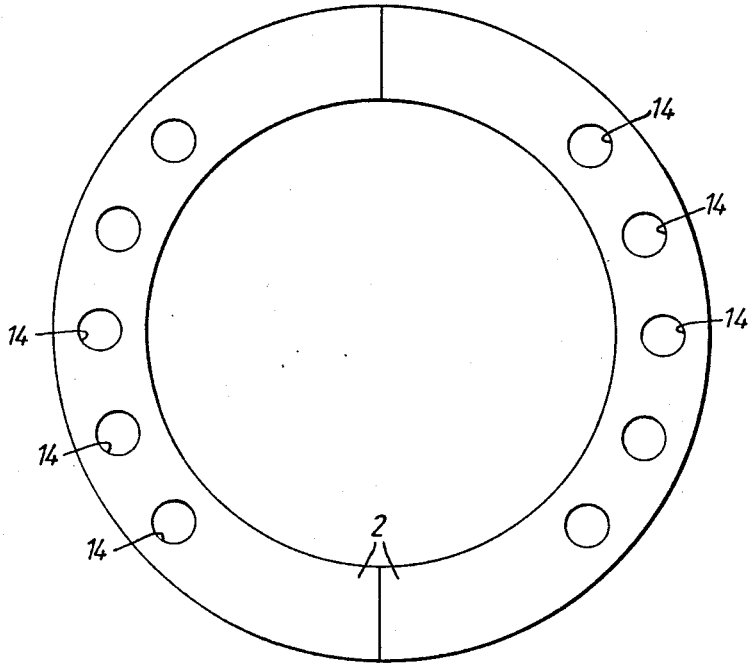
FIGS. 5, 6 and 7 are plan views, similar to FIG. 2, showing various ways of fluting the protectors.
Figure 6:
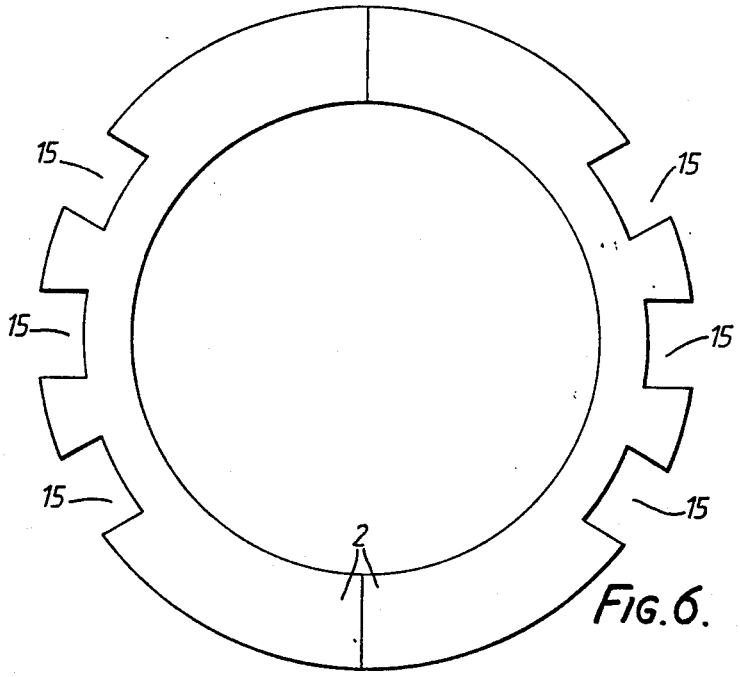
Figure 7:
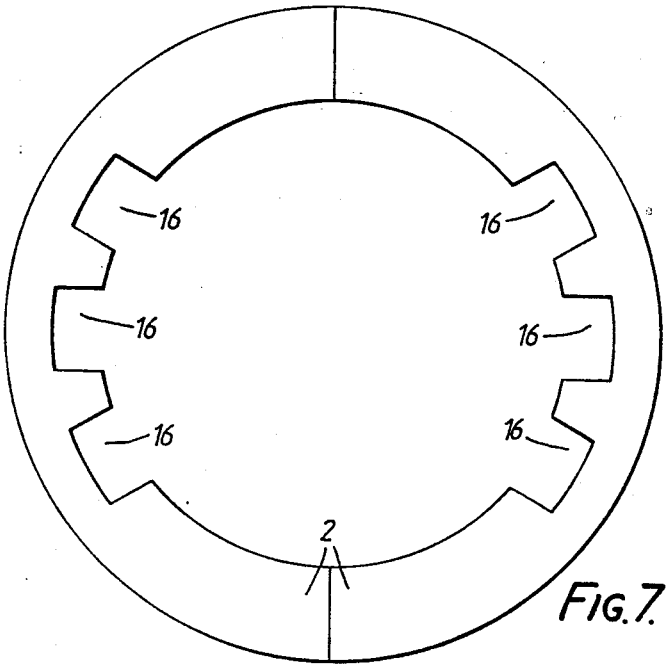

There may be circumstances in which the protector 2 as so far described would reduce the size of the so-called "annulus" referred to above to a magnitude insufficient to allow the required volume of fluid to flow per unit time and FIGS. 5, 6 and 7 of the drawings illustrate ways in which the flow constraint constituted by the presence of the protector 2 can be significantly reduced whilst retaining the internal and external diameters 5 and 6 thereof. The flow-restricting area of the protector 2 is significantly reduced by providing in each of its halves so-called "flutes" through which fluids, such as gas, oil and/or water, can flow. FIG. 5 illustrates the formation of tubular flutes 14 in each of the two juxtaposed halves of the annular protector 2 whilst FIG. 6 illustrates the provision of channel-shaped flutes 15 in the convex outer surface of each half of the protector 2 and FIG. 7 shows the provision of channel-shaped flutes 16 in the convex internal surface of each half of the protector 2. The flutes 14, 15 and 16 all extend parallel to the longitudinal axis of the protector 2 concerned throughout the axial length 7 of that protector and it will be realised from a comparison between FIG. 3 and FIGS. 5, 6 and 7 of the drawings that the various flutes are ommitted in the regions of the two halves of the protector 2 that are formed with the slots 9 and with the registering bores which together accommodate the bolts 8 and associated parts that firmly secure said halves to one another. The flutes 14, 15 or 16 may, if desired, be wound helically around the longitudinal axis of the protector 2, instead of extending strictly parallel to that axis, and it will be realised that other shaping and/or positioning of the flutes is possible to reduce the area of the protector 2 which otherwise restricts the flow of fluid between the external convex surface of a drill pipe 1 and the internal concave surface of the surrounding bore hole casing.

Protectors that are similar in construction to the protectors 2 which have so far been described can be located close to the joints between drill pipe sections 1 and at various locations along an entire drill string. It is particularly desirable that they should be provided at locations where a bore hole is deliberately caused to change its direction, such locations being known as "kickoffs". There is an increased likelihood of the drill string and the bore hole casing coming into contact with one another at such locations with resultant frictional wear but, almost always, locations of this kind are relatively near to the ground surface or upper end of the bore hole so that the ambient temperature will usually be relatively low at such a point. Accordingly, different materials could be used for the protectors 2 at such locations to those which have already been mentioned, such different materials having all of the required features discussed above except for tolerance of relatively high temperatures. The cost may be reduced by using protectors 2 comprising such materials at appropriate locations. In these and other cases, it might be possible to use protectors 2 made from different basic materials at various locations along a single drill pipe string but, naturally, the circumstances of individual wells vary very considerably and the best arrangements for different wells will need to be decided for each particular case.

Figure 8:
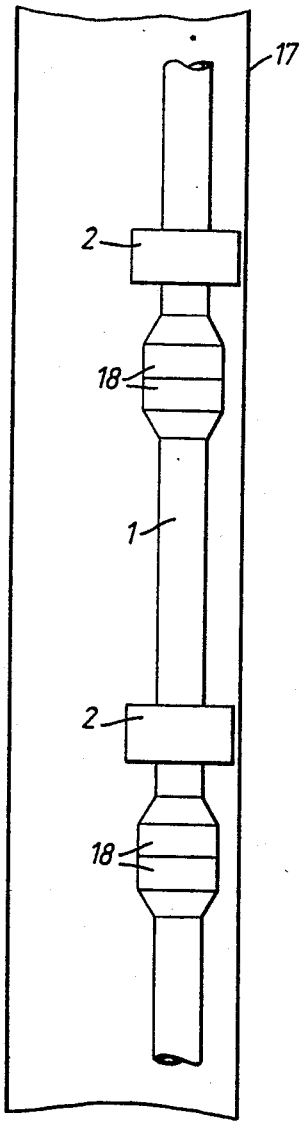

FIGS. 8 to 13 inclusive somewhat diagrammatically show a number of operating possibilities. FIG. 8 shows a relatively large diameter bore hole casing 17 in which a "string" of drill pipe sections 1 is arranged, the diameter of each section 1 being very significantly less than the internal diameter of the casing 17. Each section 1 is provided with its own individual single protector 2 which can float upwardly and downwardly in the directions 3 (FIG. 1) throughout the length of the section 1 concerned except, of course, at the relatively short end portions thereof which constitute a joint 18. Each protector 2 can also rotate freely in either of the directions 4 (FIG. 1) as well as being able to "float" in the directions 3. It is not always necessary that each drill pipe section 1 should have its own individual protector and, in some cases, a protector 2 on every second or third drill pipe section 1 of the string will suffice depending upon the requirements of the particular well being dealt with.

Figure 9:
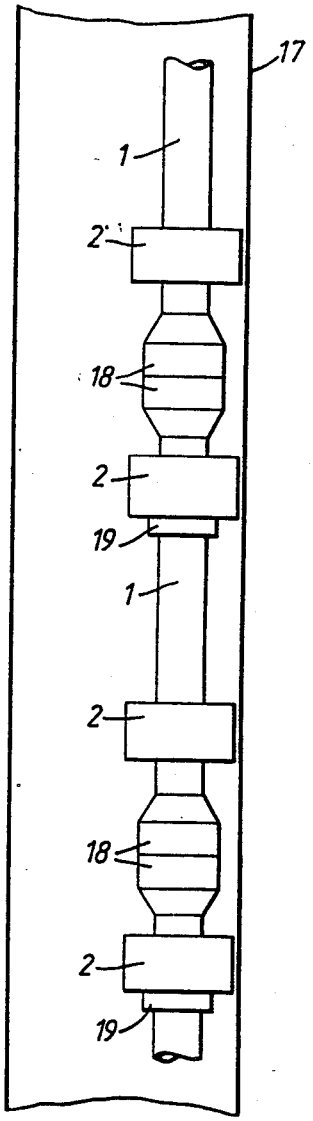

FIG. 9 shows an arrangement where retaining rings 19 are firmly secured around the drill pipe sections 1 at various locations to limit the freedom of movement of the protectors 2 in the directions 3. It will be noted from FIG. 9 that each retaining ring 19 is located towards the upper end of the corresponding pipe section 1 and that there is an upper protector 2 above that retaining ring 19 and a lower protector 2 between the ring 19 and the lower end of the pipe section 1 concerned. The arrangement of FIG. 9 ensures that the upper protector 2 of each pipe section 1 is always close to the joint 18 next above it and, of course, the particular position of each retaining ring 19 may be varied having regard to the operational circumstances of the well that is being drilled. The retaining rings 19 may be secured to the pipe sections 1 in any appropriate manner such as clamping or even the use of adhesives such as epoxy resin adhesives. It will already have been realised that the maximum outside diameter of each retaining ring 19 must be less than the maximum outside diameter of each drill pipe section 1 at the joint 18 with an upper or lower drill pipe section 1. The surfaces of the retaining rings 19 against which the protectors 2 will frequently bear, during operation, and relative to which surfaces those protectors will rotate, should be as smooth as practicable and as nearly perpendicular as possible to the longitudinal axis of the drill pipe section 1 concerned. The rings 19 will thus provide positive stops against movements of the protectors 2 in the directions 3 and will not wear the protectors 2 to any significant extent. If the drill pipe sections 1 of FIGS. 8 and 9 of the drawings have external diameters of substantially 127 mm, the maximum diameter of each retaining ring 19 should be significantly less than substantially 171.4 mm which is the outer diameter of each joint 18. It will be understood that these measurements can be appropriately varied for drill pipe sections 1 of differing outer diameters and, sometimes, for casings 17 that surround the drill string much more closely than is illustrated in FIGS. 8 and 9. Under some circumstances, three or more protectors 2 per drill pipe section 1 may be required, being allied with an appropriate number of retaining rings 19 that are so disposed as to allow the protectors 2 to move lengthwise only along corresponding portions of each section.

Figure 10:
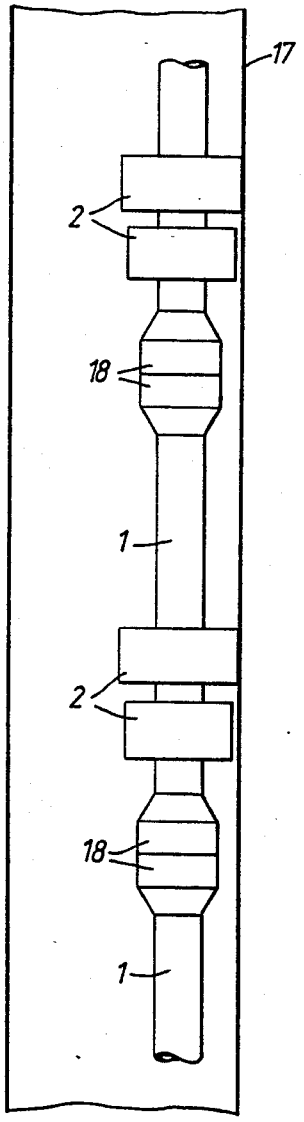

FIG. 10 illustrates an arrangement in which two protectors 2 are arranged on each pipe section 1, there being an upper protector 2 of marginally greater external diameter than is a corresponding lower protector 2. Both of these upper and lower protectors 2 have substantially the same internal diameter. If, during operation, the upper protector 2 should come into contact with the casing 17 and be caused to moved upwardly along the pipe section 1 concerned until it reaches the joint 18 next thereabove, the corresponding lower protector 2 would, usually, not be so displaced and would remain close to the joint 18 next therebelow. If considered necessary in any particular case, a retaining ring 19 could be arranged around each drill pipe section 1 immediately above the lower protector 2 to ensure that said lower protector 2 of smaller external diameter would always remain close to the joint 18 next therebelow and could not follow its companion upper protector 2 upwardly towards the joint 18 next thereabove.

Figure 11:
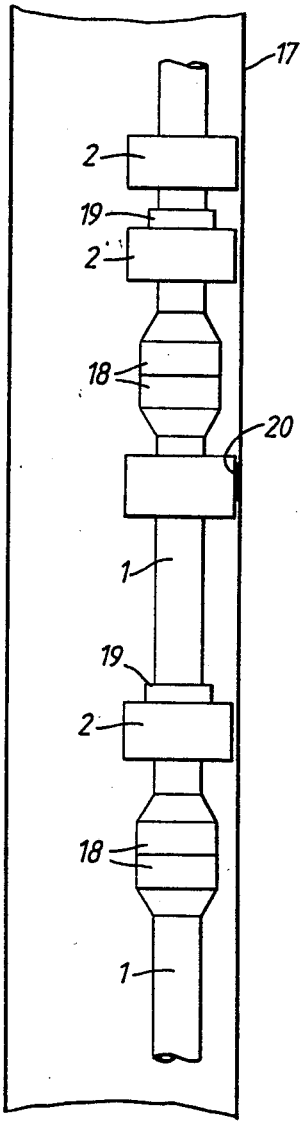

FIG. 11 shows an arrangement in which there are two protectors 2 of equal external diameter on each drill pipe section 1 with a retaining ring 19 arranged above each lower protector 2 to restrict movement of that lower protector 2 in the directions 3 (FIG. 1) to a relatively short length of the section 1 concerned at the lower end of the latter. The corresponding upper protector 2 can float in the direction 3 between the retaining ring 19 and the joint 18 at the upper end of that section 1. The lower protector 2 thus always remains close to the joint 18 next therebelow whilst the upper protector 2 may be displaced upwardly if it should, for example, come into contact with a casing anomaly 20 as is shown approximately centrally at the right side of FIG. 11. Thus, the upper protector 2 of each pair affords protection throughout the length of the corresponding pipe section 1 which lies above the retaining ring 19.

Figure 12:
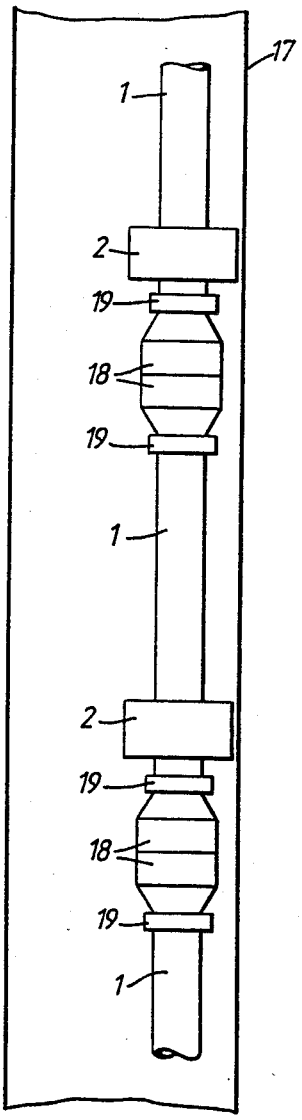

FIG. 12 shows an arrangement in which each pipe section 1 carries only a single protector 2 that is disposed between two retaining rings 19 secured to the section 1 concerned immediately adjacent the commencement of the conical enlargement thereof to form a joint 18. Such conical or other shaping of each drill pipe section 1 can cause difficulties should there be a strong force tending to retain a protector 2 in a fixed lengthwise position relative to the casing 17 since subsequent downward displacement of the drill pipe string will exert a force upon the protector 2 concerned that will tend to split the latter. This possibility is avoided by disposing the retaining rings 19 as shown in FIG. 12 of the drawings since each protector 2 will never directly contact one of the conical surfaces of a neighbouring joint 18 but will bear by way of its own flat surface against a flat surface of one of the retaining rings 19, both surfaces being perpendicular or substantially perpendicular to the longitudinal axis of the pipe section 1 under consideration. Naturally, the retaining rings 19 that have already been mentioned above also avoid any tendency to splitting of the protectors 2 by contacting the latter only with a flat surface that is substantially perpendicular to the longitudinal axis of the section 1. Apart from the provision of the retaining rings 19, the arrangement shown in FIG. 12 is identical to that described with reference to FIG. 8.

Figure 13:
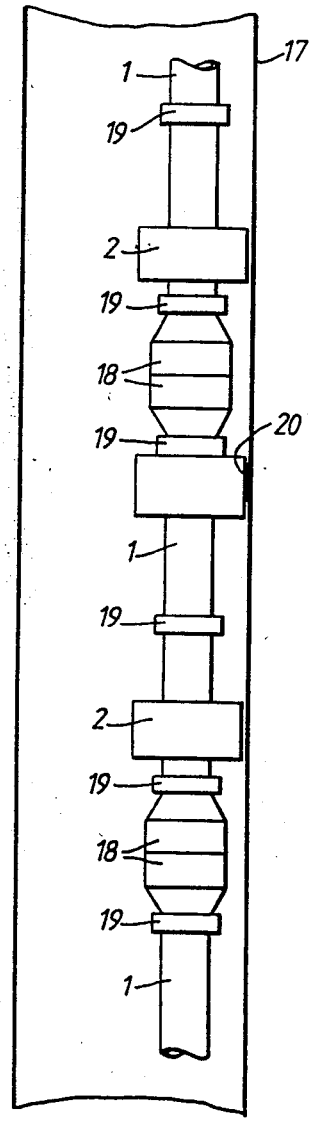

FIG. 13 shows an arrangement which is similar to that of FIG. 12 except that each pipe section 1 carries a pair of upper and lower protectors 2 of the same external diameter, a third retaining ring 19 being arranged between them at a location substantially mid-way between the joints 18 at the opposite ends of that section 1. Each protector 2 is thus effective throughout substantially half of the length of the corresponding pipe section and FIG. 13 shows the upper protector 2 corresponding to the central pipe section 1 of that Figure displaced upwardly along said section 1 into contact with the retaining ring 19 neighbouring the upper joint 18 concerned due to having contacted a casing anomaly 20 on the internal concave cylindrical surface of the bore hole casing 17 surrounding the drill string.

It is emphasised that the arrangements described with reference to FIG. 8 to 13 inclusive of the drawings are only examples of many possibilities and that the particular arrangements which will best suit each bore hole require consideration having regard to the many variable circumstances of different bore holes. As an alternative to the arrangement which has been described with reference to FIG. 3 and 4 of the drawings, the generally annular protectors 2 could incorporate a hinge between their two initially separate halves, such protectors 2 being closed around the drill pipe section 1 concerned by, for example, a pair of bolts and other parts arranged at the opposite side of the protector from the hinge, such bolts and associated parts being constructed and arranged substantially as has been described for one set thereof with reference to FIGS. 3 and 4. It is noted that the retaining rings 19 have not been described in detail since there are several known constructions which could serve this purpose with, at the most, only a minimum of simple adaptation.

What I claim is:

1. A floating drill pipe tubing and casing protector comprising:

(a) at least one annular protector arranged to embrace a drill pipe section, wherein said annular protector is constructed and arranged so as to be freely rotatable around the longitudinal axis of the drill pipe section and displaceable lengthwise along said drill pipe section;

said protector being of a polytetraflourethylene material and comprising two juxtaposed halves, each having an upper section and a lower section, each half comprising:

(i) a convex inner surface and a convex outer surface, the inner and outer surfaces having flutes formed through the axial thickness thereof for the passage of fluid therethrough;

(ii) at least one slot formed in the upper and the lower sections of each half; the slots being lined with a stainless steel sleeve, the sleeve having a bore formed therein for receipt of a recessed fastening means, and (b) retaining means associated with the protector to limit the extent of the lengthwise displaceability of the protector along the drill pipe section.

2. A protector according to claim 1, wherein at least one associated retaining ring is disposed adjacent to a junction between two successive drill pipe sections so that said protector is movable lengthwise along the corresponding drill pipe section only throughout the restricted distance between said retaining ring and said junction.

3. The floating drill pipe tubing and casing protector of claim 1, wherein the diameter of the protector is varied to restrict movement thereof.

4. The floating drill pipe tubing and casing protector of claim 3 further comprising: a retaining ring arranged to limit upward and downward movement of the protector.

5. The system of claim 1 wherein the annular protector further comprises: a hinge for connecting the two halves of the protector.

6. A system of drill pipe tubing and casing protectors comprising:

(a) a first annular protector;

(b) a second annular protector having an external diameter smaller than the first protector and located below the first protector; and (c) at least one retaining ring arranged immediately above the second annular protector to prevent contact between the protector and a drill pipe joint.

7. A system of drill pipe tubing and casing protectors for use with a drill pipe casing having a series of joints comprising:

(a) a first annular protector;

(b) a second annular protector;

(c) three retaining rings arranged so that the first retaining ring is located above the first annular protector the second retaining ring is located below the first annular protector and above the second annular protector and the third protective ring is located below the second annular protector, thus preventing contact between the protectors and the drill pipe joints.

* * * * *